US005313554A

United States Patent [19]

Ketchum

[11] Patent Number: 5,313,554

[45] Date of Patent: May 17, 1994

[54] BACKWARD GAIN ADAPTATION METHOD IN CODE EXCITED LINEAR PREDICTION CODERS

[75] Inventor: Richard H. Ketchum, Wheaton, Ill.

[73] Assignee: AT&T Bell Laboratories, Murray Hill, N.J.

[21] Appl. No.: 899,529

[22] Filed: Jun. 16, 1992

[51] Int. Cl.[5] ..... G10L 9/02

[52] U.S. Cl. ..... 395/2.28

[58] Field of Search ..... 395/2.28; 381/35-51

[56] References Cited

U.S. PATENT DOCUMENTS 4,963,034 10/1990 Cuperman ..... 381/35
4,982,428 2/1990 Agazzi ..... 379/411
5,187,745 2/1993 Yip et al. ..... 381/36

OTHER PUBLICATIONS

Dymarski P., et al., "Optimal and suboptimal algorithms for selecting the excitation in linear predictive coders", ICASSP 90, vol. 1, pp. 485-488, IEEE, 1990.

J. Chen et al., "A Fixed-Point 16 Kb/s LD-CELP Algorithm", *ICASSP 90 Proceedings,* 1990 International Conference on Acoustics, Speech, and Signal Processing, Apr. 3-6, 1990, pp. 21-24.

J. Chen, "High-Quality 16 Kb/s Speech Coding with a One-Way Delay Less Than 2 ms", *ICASSP 91 Proceedings,* 1991 International Conference on Acoustics, Speech, and Signal Processing, May 14-17, 1991, pp. 453-456.

CCITT Draft Recommendation G.72x, Coding of Speech at 16 kbit/s Using Low-Delay Code Excited Linear Prediction (LD-CELP), pp. 1-30, Nov. 1991, Study Group XV.

*Primary Examiner*—Michael R. Fleming
*Assistant Examiner*—Michelle Doerrler
*Attorney, Agent, or Firm*—Michael B. Johannesen

[57] ABSTRACT

An exemplary CELP coder where gain adaptation is performed using previous gain values in conjunction with an entry in a table comprising the logarithms of the root-mean-squared values of the codebook vectors, to predict the next gain value. Not only is this method less complex because the table entries are determined off-line, but in addition the use of a table at both the encoder and the decoder allows fixed-point/floating-point interoperability requirements to be met.

11 Claims, 6 Drawing Sheets

BACKWARD GAIN ADAPTATION METHOD IN CODE EXCITED LINEAR PREDICTION CODERS

TECHNICAL FIELD

This invention relates to speech processing.

BACKGROUND AND PROBLEM

Low bit rate voice coding can provide very efficient communications capability for such applications as voice mail, secure telephony, integrated voice and data transmission over packet networks, and narrow band cellular radio. Code excited linear prediction (CELP) is a coding method that offers robust, intelligible, good quality speech at low bit rates, e.g., 4.8 to 16 kilobits per second. Although based on the principles of linear predictive coding (LPC), CELP uses analysis-by-synthesis vector quantization to match the input speech, rather than imposing any strict excitation model. As a result, CELP sounds less mechanical than traditional CELP coders, and it is more robust to non-speech sounds and environmental noise. CELP has been shown to provide a high degree of speaker identifiability as well.

Because the excitation is determined through an exhaustive analysis-by-synthesis vector quantization approach, the CELP method is computationally complex. A backward gain adaptation is typically performed in CELP coders to scale the amplitude of the codebook vectors (codevectors) to the input speech based on previous gain values. Such adaptation is carried out at both ends of the communication. However, the accuracy of the adaptation process has not been sufficient to meet requirements specified for the interoperability of fixed-point CELP encoders with floating-point CELP decoders and vice versa.

In view of the foregoing, improvements are needed in both the accuracy and computational complexity of CELP coders.

Solution

Such improvements are made and a technical advance is achieved in accordance with the principles of the invention in an exemplary CELP coder where gain adaptation is performed using previous gain values in conjunction with an entry in, significantly, a table comprising the logarithms of the root-mean-squared values of the codebook vectors, to predict the next gain value. The table entry is selected using the excitation vector index. Not only is this method less complex because the table entries are predetermined off-line, but in addition the use of a table at both the encoder and the decoder allows fixed-point/floating-point interoperability requirements to be met.

In accordance with the invention, a CELP encoder receives a first segment of input speech and determines a first input speech vector therefrom. A plurality of codevectors from a codebook of vectors are scaled by a first gain value. First speech vectors are synthesized from each of the first gain scaled codevectors and then compared with the first input speech vector. A first codevector is selected based on the comparison. A first value, corresponding to the selected first codevector, is selected from a table comprising the logarithms of the root-mean-squared values of the codevectors. A second logarithmic gain value is predicted based on the selected first value and the logarithm of the first gain value. The inverse logarithm of the predicted second logarithmic gain value gives a second gain value. A low bit rate speech signal representing the first input speech segment is generated based on the selected first codevector.

The CELP encoder receives a second segment of input speech and determines a second input speech vector therefrom. The plurality of codevectors are scaled by the second gain value. Second speech vectors are synthesized from each of the second gain scaled codevectors and then compared with the second input speech vector. A second codevector is selected based on the comparison. A second value, corresponding to the selected second codevector, is selected from the table comprising the logarithms of the root-mean-squared values of the codevectors. A third logarithmic gain value is predicted based on the selected second value and the logarithm of the second gain value. The inverse logarithm of the predicted third logarithmic gain gives a third gain value for use in processing a third segment of input speech. A low bit rate speech signal representing the second input speech segment is generated based on the selected second codevector.

In accordance with the invention, a CELP decoder receives a low bit rate first speech signal and, based on the received signal, selects a first codevector from a codebook of vectors. The selected first codevector is then scaled by a first gain value. A first value, corresponding to the selected first codevector, is selected from a table comprising the logarithms of the root-mean-squared values of a plurality of codevectors in the codebook. A second logarithmic gain value is predicted based on the selected first value and the logarithm of the first gain value. The inverse logarithm of the predicted second logarithmic gain value gives a second gain value. A first segment of output speech is synthesized based on the first gain scaled first codevector.

The CELP decoder receives a low bit rate second speech signal, and based on the received signal, selects a second codevector from the codebook. The selected second codevector is then scaled by the second gain value. A second value, corresponding to the selected second codevector, is selected from the table comprising the logarithms of the root-mean-squared values of the codevectors. A third logarithmic gain value is predicted based on the selected second value and the logarithm of the second gain value. The inverse logarithm of the predicted third logarithmic gain value gives a third gain value for use in processing a low bit rate third speech signal. A second segment of output speech is synthesized based on the second gain scaled second codevector.

The invention is applicable to both fixed-point and floating-point encoders and decoders and is particularly applicable in low-delay CELP.

DRAWING DESCRIPTION

DETAILED DESCRIPTION

The low-delay code excited linear prediction method is described herein with respect to an encoder 5 (FIG. 1) and a decoder 6 (FIG. 6) and is described in greater detail in CCITT Draft Recommendation G.72x, Coding of Speech at 16 Kilobits per second Using LD-CELP, Nov. 11–22, 1991, which is incorporated by reference herein.

The essence of CELP techniques, which is an analysis-by-synthesis approach to codebook search, is retained in LD-CELP. The LD-CELP however, uses backward adaptation of predictors and gain to achieve an algorithmic delay of 0.625 ms. Only the index to the excitation codebook is transmitted. The predictor coefficients are updated through LPC analysis of previously quantized speech. The excitation gain is updated by using the gain information embedded in the previously quantized excitation. The block size for the excitation vector and gain adaptation is 5 samples only. A perceptual weighting filter is updated using LPC analysis of the unquantized speech.

Figure 1:
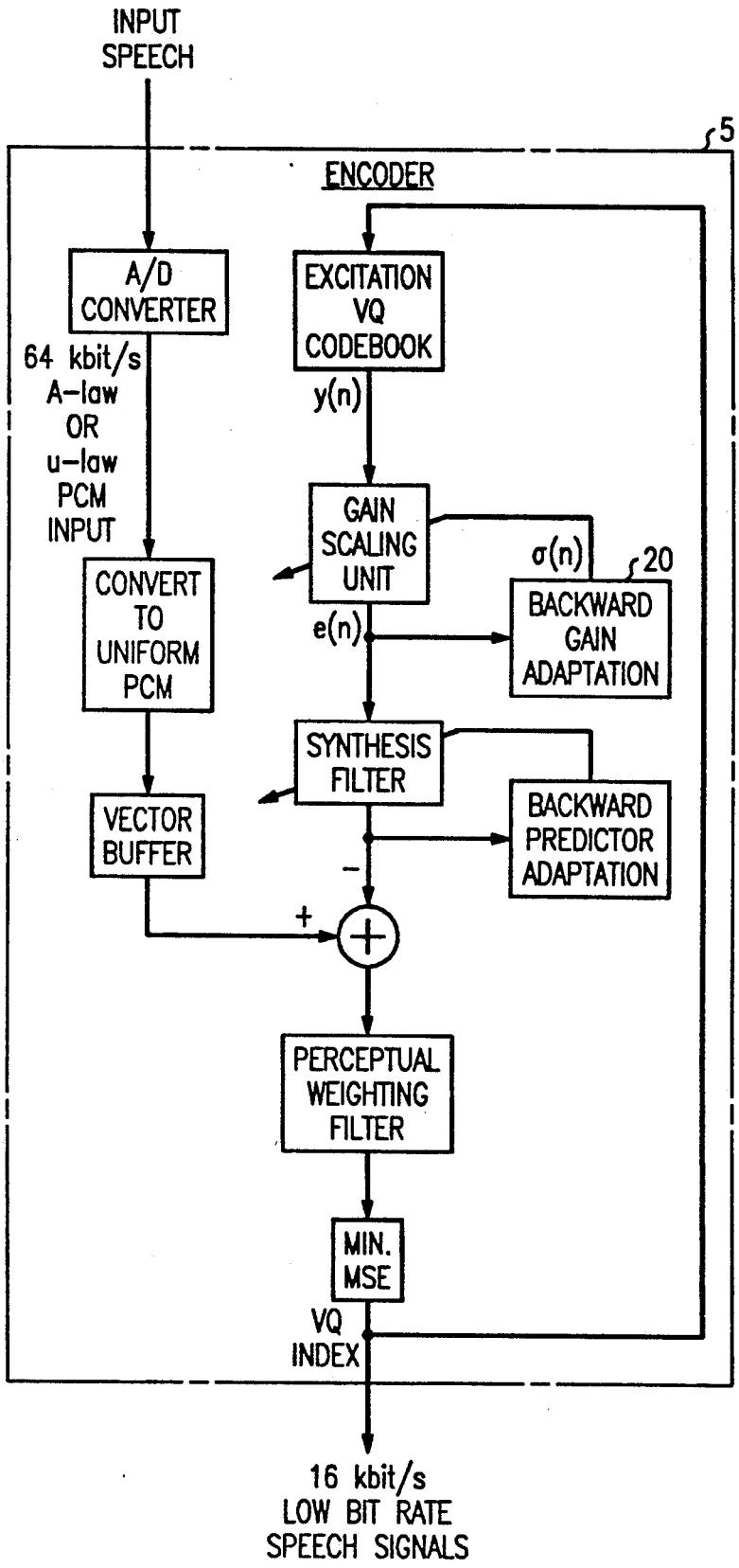
(PRIOR ART) FIG. 1
FIG. 1 is a block diagram of a prior art low-delay CELP (LD-CELP) encoder.

CELP Encoder 5 (FIG. 1)

After the input speech is digitized and converted from A-law or $\mu$-law PCM to uniform PCM, the input signal is partitioned into blocks of 5 consecutive input signal samples. For each input block, encoder 5 passes each of 1024 candidate codebook vectors (stored in an excitation codebook) through a gain scaling unit and a synthesis filter. From the resulting 1024 candidate quantized signal vectors, the encoder identifies the one that minimizes a frequency-weighted mean-squared error measure with respect to the input signal vector. The 10-bit codebook index of the corresponding best codebook vector (or "codevector") which gives rise to that best candidate quantized signal vector is transmitted to the decoder. The best codevector is then passed through the gain scaling unit and the synthesis filter to establish the correct filter memory in preparation for the encoding of the next signal vector. The synthesis filter coefficients and the gain are updated periodically in a backward adaptive manner based on the previously quantized signal and gain-scaled excitation.

Figure 2:
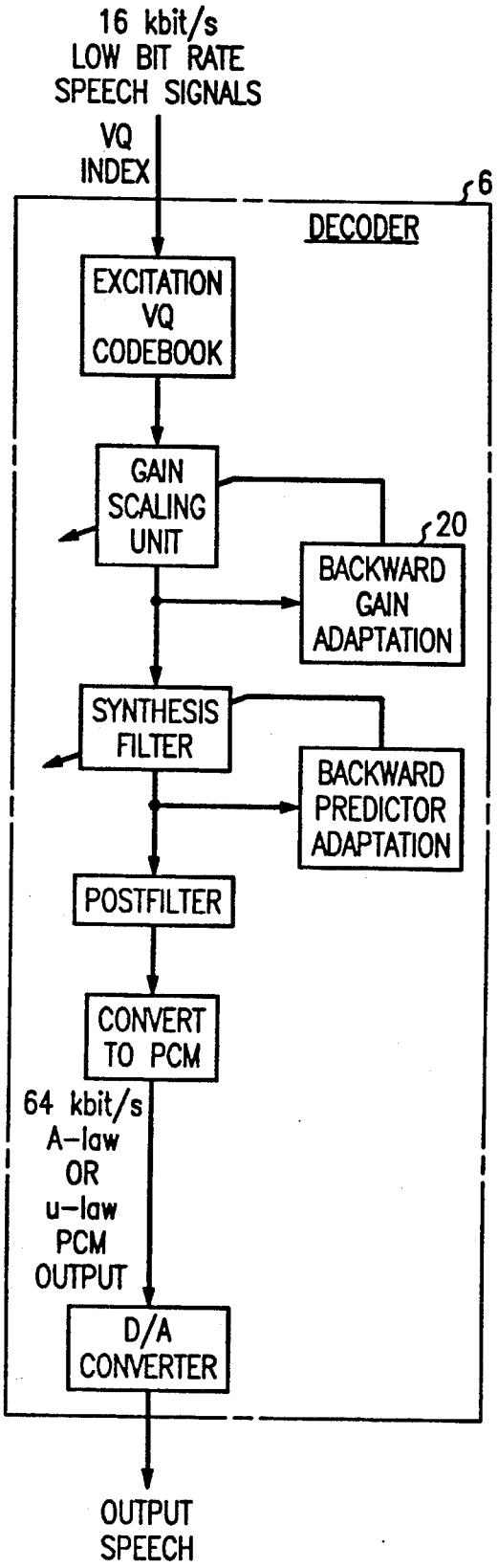
(PRIOR ART) FIG. 2
FIG. 2 is a block diagram of a prior art low-delay CELP decoder.

CELP Decoder 6 (FIG. 2)

The decoding operation is also performed on a block-by-block basis. Upon receiving each 10-bit index (low bit rate speech signal), decoder 6 performs a table look-up to extract the corresponding codevector from the excitation codebook. The extracted codevector is then passed through a gain scaling unit and a synthesis filter to produce the current decoded signal vector. The synthesis filter coefficients and the gain are then updated in the same way as in the encoder. The decoded signal vector is then passed through an adaptive postfilter to enhance the perceptual quality. The postfilter coefficients are updated periodically using the information available at the decoder. The 5 samples of the postfilter signal vector are next converted to 5 A-law or $\mu$-law PCM output samples, and then to synthetic output speech.

Figure 3:
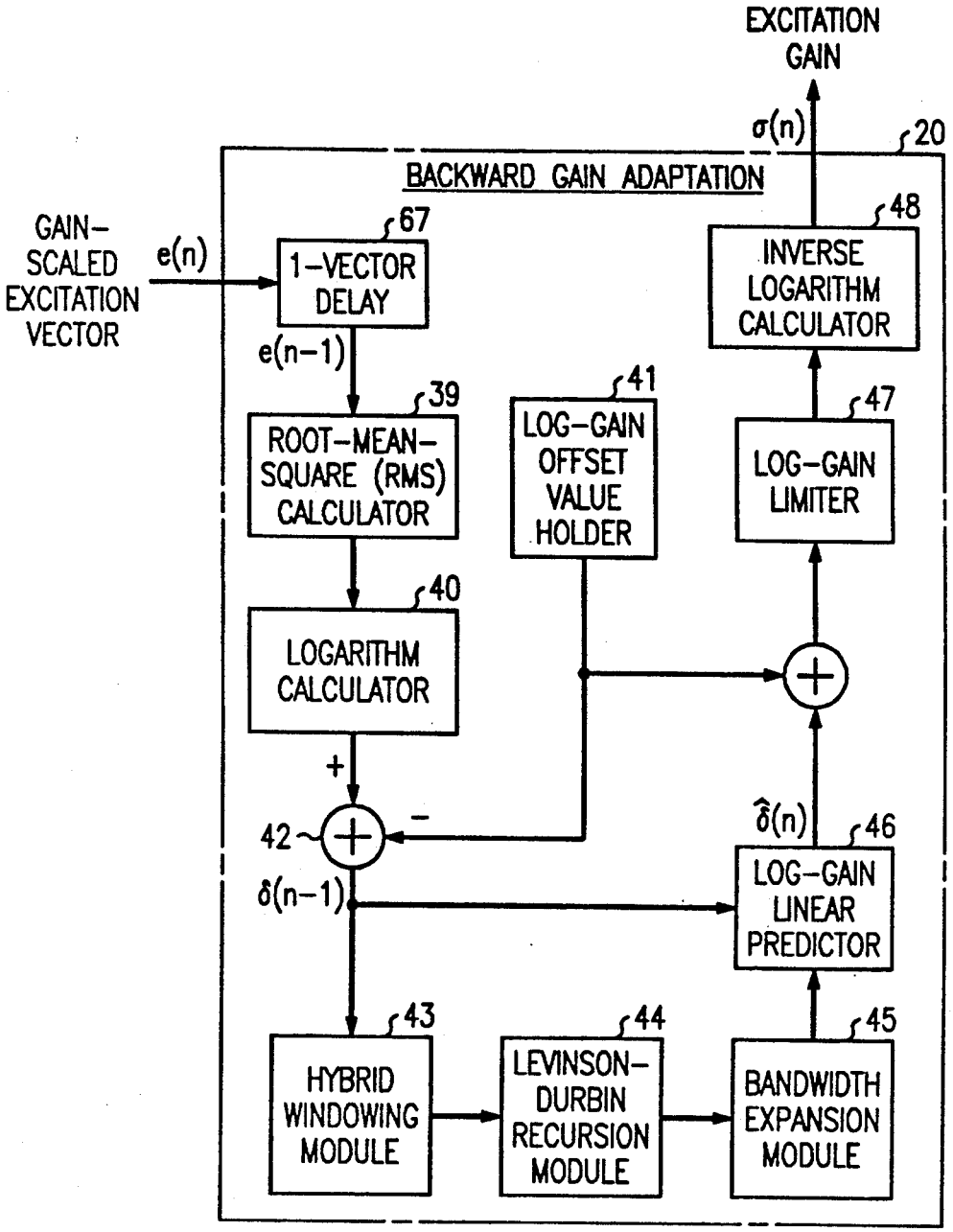
(PRIOR ART) FIG. 3
FIG. 3 is a block diagram of a prior art backward gain adapter used in the encoder of FIG. 1 and the decoder of FIG. 2.

Backward Vector Gain Adapter 20 (FIG. 3)

Adapter 20 updates the excitation gain $\sigma(n)$ for every vector time index n. The excitation gain $\sigma(n)$ is a scaling factor used to scale the selected excitation vector y(n). Adapter 20 takes the gain-scaled excitation vector e(n) as its input, and produces an excitation gain $\sigma(n)$ as its output. Basically, it attempts to "predict" the gain of e(n) based on the gains of e(n−1), e(n−2), . . . by using adaptive linear prediction in the logarithmic gain domain.

The 1-vector delay unit 67 makes the previous gain-scaled excitation vector e(n−1) available. The Root-Mean-Square (RMS) calculator 39 then calculates the RMS value of the vector e(n−1). Next, the logarithm calculator 40 calculates the dB value of the RMS of e(n−1), by first computing the base 10 logarithm and then multiplying the result by 20.

A log-gain offset value of 32 dB is stored in the log-gain offset value holder 41. This value is meant to be roughly equal to the average excitation gain level (in dB) during voiced speech. Adder 42 subtracts this log-gain offset value from the logarithmic gain produced by the logarithm calculator 40. The resulting offset-removed logarithmic gain $\delta(n-1)$ is then used by the hybrid windowing module 43 and the Levinson-Durbin recursion module 44. Note that only one gain value is produced for every 5 speech samples. The hybrid window parameters of block 43 are M=10, N=20, L=4, $\alpha=[\frac{3}{4}]^{\frac{1}{8}}=0.96467863$.

The output of the Levinson-Durbin recursion module 44 is a set of coefficients of a 10-th order linear predictor with a transfer function of $$\hat{R}(z) = -\sum_{i=1}^{10} \hat{a}_i z^{-i}.$$

The bandwidth expansion module 45 then moves the roots of this polynomial radially toward the z-plane original. The resulting bandwidth-expanded gain predictor has a transfer function of $$R(z) = -\sum_{i=1}^{10} a_i z^{-i},$$

where the coefficients $a_i$'s are computed as $$a_i = \left(\frac{29}{32}\right)^i \hat{a}_i = (0.90625)^i \hat{a}_i.$$

Such bandwidth expansion makes gain adapter 20 more robust to channel errors. These $a_1$'s are then used as the coefficients of log-gain linear predictor 46.

Predictor 46 is updated once every 4 speech vectors, and the updates take place at the second speech vector of every 4-vector adaptation cycle. The predictor attempts to predict $\delta(n)$ based on a linear combination of $\delta(n-1), \delta(n-2) \ldots, \delta(n-10)$. The predicted version of $\delta(n)$ is denoted as $\hat{\delta}(n)$ and is given by $$\hat{\delta}(n) = -\sum_{i=1}^{10} a_i \delta(n-i).$$

After $\hat{\delta}(n)$ has been produced by the log-gain linear predictor 46, the log-gain offset value of 32 dB stored in 41 is added back. Log-gain limiter 47 then checks the resulting log-gain value and clips it if the value is unreasonably large or unreasonably small. The lower and upper limits are set to 0 dB and 60 dB, respectively. The gain limiter output is then fed to the inverse logarithm calculator 48, which reverses the operation of the logarithm calculator 40 and converts the gain from the dB value to the linear domain. The gain limiter ensures that the gain in the linear domain is in between 1 and 1000.

Figure 4:
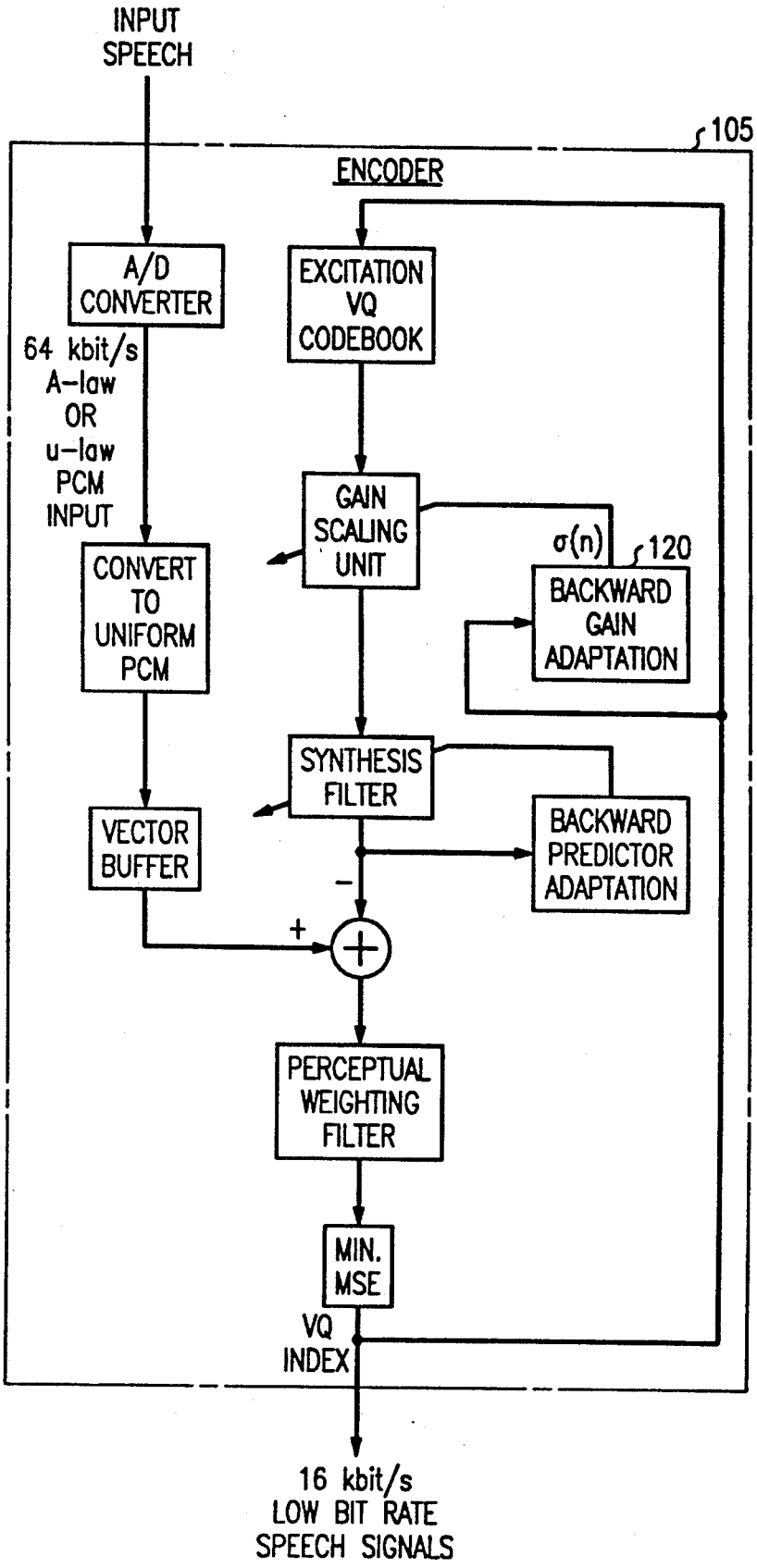
FIG. 4 is a block diagram of an LD-CELP encoder in accordance with the present invention.
Figure 5:
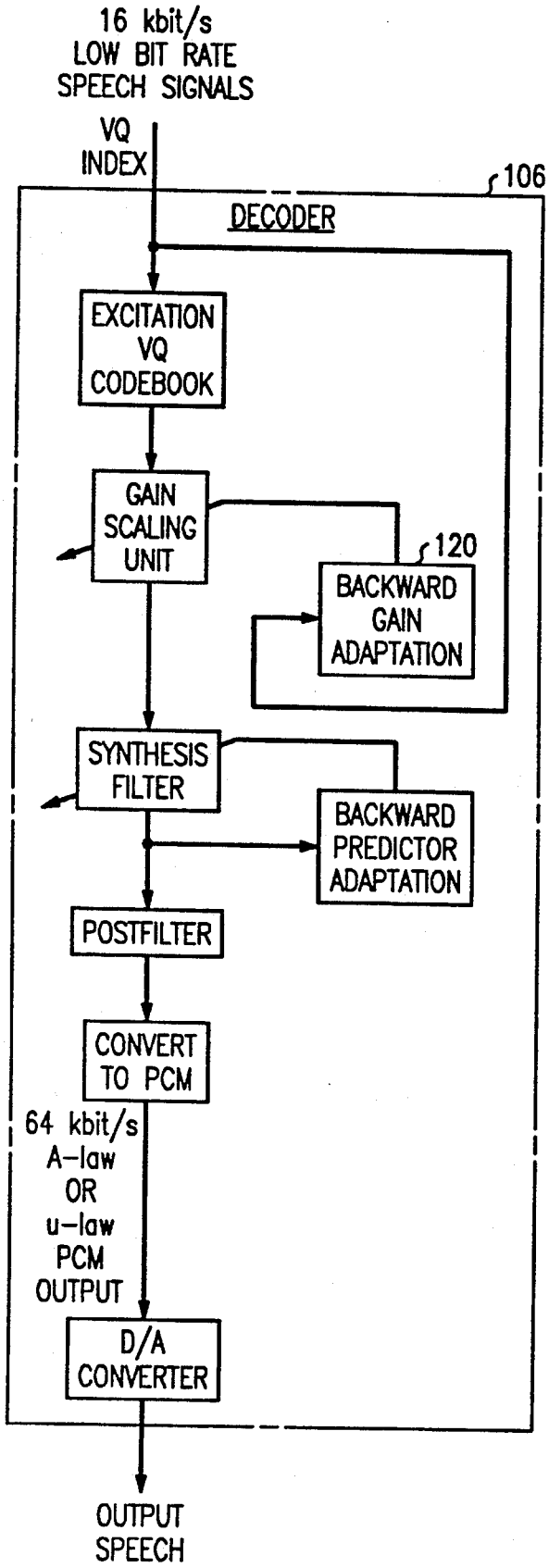
FIG. 5 is a block diagram of an LD-CELP decoder in accordance with the present invention.

Encoder 105 (FIG. 4) and Decoder 106 (FIG. 5)

The present invention is focused on changes in backward gain adapter 120 and its operation with the gain scaling unit in low-delay encoder 105 (FIG. 4) and in low-delay decoder 106 (FIG. 5). Note that in both encoder 105 and decoder 106, backward gain adapter 120 receives the low bit rate speech signal (the excitation vector index) as its input rather than the gain-scaled excitation vector.

Figure 6:
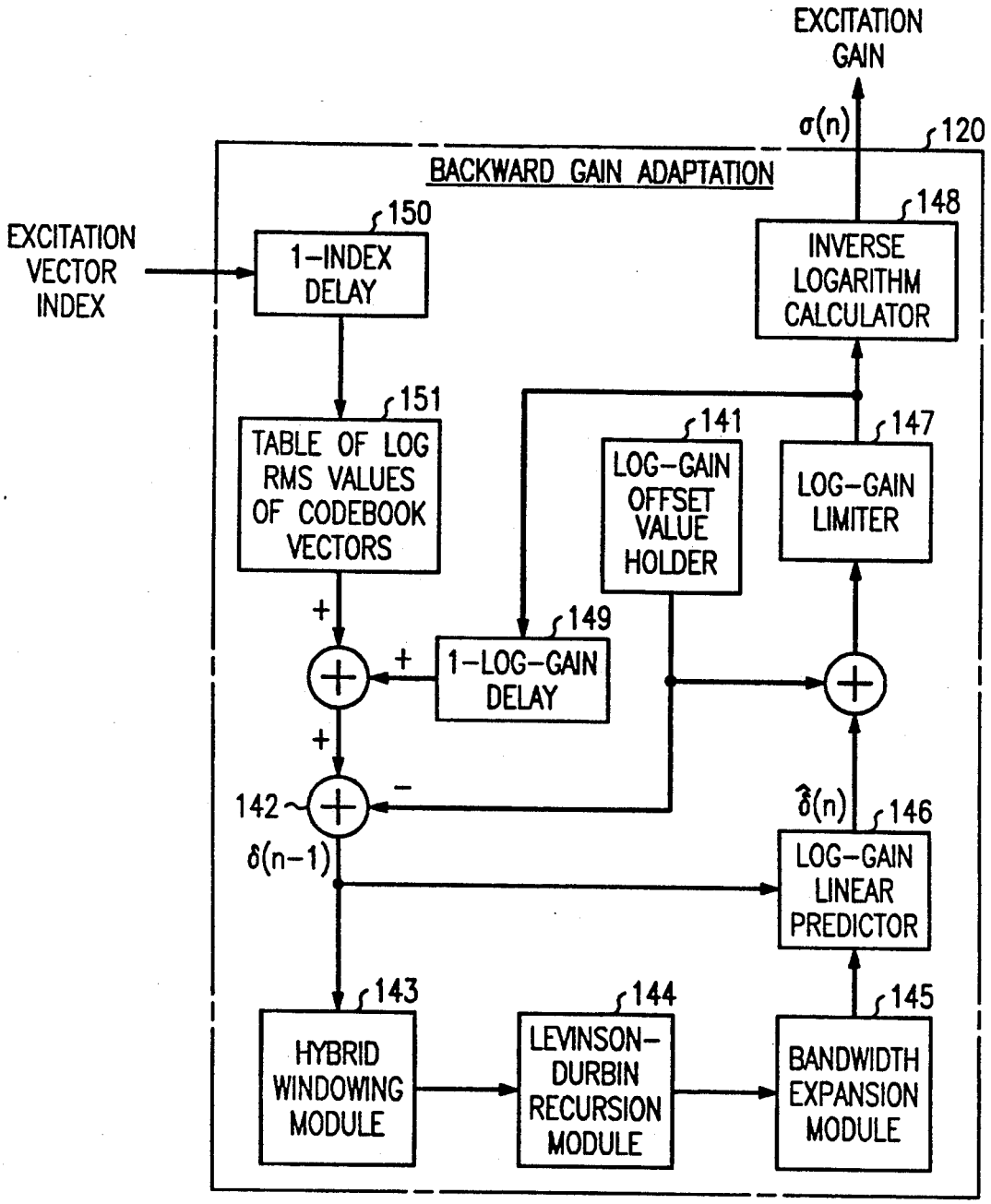
FIG. 6 is a block diagram of a backward gain adapter in accordance with present invention and used in the encoder of FIG. 4 and the decoder of FIG. 5.

Backward Vector Gain Adapter 120 (FIG. 6)

Backward gain adapter 120 is shown in FIG. 6. Delay units 149 and 150 are only included to aid in understanding the time sequential operation of the closed loop comprising backward gain adapter 120 and the gain scaling unit. The previous excitation vector index is used to select a value from a table 151 comprising the logarithms of the root-means-squared values of the codevectors in the excitation codebook (FIGS. 4 and 5). The logarithm and root-mean-squared processing is performed off-line. The logarithm of the previous gain value is added to the selected table value to obtain a sum. A constant offset stored by holder 141 is subtracted from the sum to obtain a difference. The next gain value is predicted based on the difference.

Overall Operation

Consider the overall operation of encoder 105 and decoder 106. In encoder 105, a first segment of the incoming input speech is converted to uniform PCM digital speech samples. Five consecutive samples are stored in a buffer to form a first input speech vector. The codevectors in the excitation codebook are scaled by the gain scaling unit using a first gain value and first speech vectors are synthesized from each of the first gain scaled codevectors. Each of the first gain scaled codevectors is compared with the first input speech vector using a minimum mean squared error criterion and a first one of the excitation codevectors is selected based on the minimum error comparison. The index of that excitation codevector is used both as the low bit rate speech signal and as the input to backward gain adapter 120. Adapter 120 predicts a second gain value in the manner described above.

A second segment of the incoming input speech in converted to uniform PCM digital speech samples. Five consecutive samples are stored in the buffer to form a second input speech vector. The codevectors in the excitation codebook are scaled by the gain scaling unit using the predicted second gain value and second speech vectors are synthesized from each of the second gain scaled codevectors. Each of the second gain scaled codevectors is compared with the second input speech vector using the minimum mean squared error criterion and a second one of the excitation codevectors is selected based on the minimum error comparison. Adapter 120 predicts a third gain value for use in processing a third segment of incoming input speech.

Decoder 106 receives a low bit rate first speech signal (excitation vector index) and uses it to select a first codevector. The selected first codevector is scaled by the gain scaling unit using a first gain value. Adapter 120 predicts a second gain value in the above described manner. A first segment of output speech is synthesized based on the first gain scaled codevector.

Decoder 106 receives a low bit rate second speech signal and uses it to select a second codevector. The selected second codevector is scaled by the gain scaling unit using the predicted second gain value. Adapter 120 predicts a third gain value for use in processing a low bit rate third speech signal. A second segment of output speech is synthesized based on the second gain scaled codevector.

Encoder 105 and decoder 106 may be implemented in floating-point, using an AT&T DSP32C digital signal processor, or in fixed-point using an AT&T DSP16 digital signal processor. The use of the same table 151 in both encoder 105 and decoder 106 allows that portion of the processing to be performed with essentially perfect accuracy. The fact that the logarithmic root-mean-squared processing is performed off-line reduces the real-time processing load of the digital signal processors. The accuracy improvement is sufficient to allow a fixed-point encoder 105 to operate with a floating-point decoder 106 and a floating-point encoder 105 to operate with a fixed-point decoder 106 within acceptable overall accuracy specifications.

It is to be understood that the above-described embodiments are merely illustrative of the principles of the invention and that many variations may be devised by those skilled in the art without departing from the spirit and scope of the invention. It is therefore intended that such variations be included within the scope of the claims.

I claim:

1. In a code excited linear prediction encoder, a method of processing input speech comprising receiving a first segment of said input speech, determining a first input speech vector from said received first segment, scaling a plurality of codevectors from a codebook of vectors by a first gain value, synthesizing first speech vectors from each of said first gain scaled codevectors, comparing each of said synthesized first speech vectors with said first input speech vector, selecting a first one of said plurality of codevectors based on said comparing of each of said synthesized first speech vectors with said first input speech vector, selecting a first value, corresponding to said selected first codevector, from a table comprising the logarithms of the root-mean-squared values of said codevectors, predicting a second logarithmic gain value based on said selected first value and the logarithm of said first gain value, obtaining the inverse logarithm of said predicted second logarithmic gain value to determine a second gain value, generating a low bit rate speech signal representing said first segment of said input speech based on said selected first codevector, receiving a second segment of said input speech, determining a second input speech vector from said received second segment, scaling said plurality of codevectors from said codebook by said second gain value, synthesizing second speech vectors from each of said second gain scaled codevectors, comparing each of said synthesized second speech vectors with said second input speech vector, selecting a second one of said plurality of codevectors based on said comparing of said synthesized second speech vectors with said second input speech vector, selecting a second value, corresponding to said selected second codevector, from said table comprising said logarithms of said root-mean-squared values of said codevectors, predicting a third logarithmic gain value based on said selected second value and the logarithm of said second gain value, obtaining the inverse logarithm of said predicted third logarithmic gain value to determine a third gain value for use in processing a third segment of said input speech, and generating a low bit rate speech signal representing said second segment of said input speech based said selected second codevector.

2. A method in accordance with claim 1 wherein the arithmetic operations of said method in said encoder are performed using fixed-point arithmetic, said method further comprising transmitting said low bit rate speech signal to a decoder having a table identical to said table comprising the logarithms of the root-mean-squared values of said codevectors, and wherein arithmetic operations are performed in said decoder using floating-point arithmetic.

3. A method in accordance with claim 1 wherein the arithmetic operations of said method in said encoder are performed using floating-point arithmetic, said method further comprising transmitting said low bit rate speech signal to a decoder having a table identical to said table comprising the logarithms of the root-mean-squared values of said codevectors, and wherein arithmetic operations are performed in said decoder using fixed-point arithmetic.

4. A method in accordance with claim 1 wherein said encoder is a low-delay code excited linear prediction encoder.

5. A method in accordance with claim 1 wherein said predicting said second logarithmic gain comprises adding said selected first value and said logarithm of said first gain value to obtain a first sum, subtracting a constant offset from said first sum to obtain a first difference, and predicting said second logarithmic gain based on said first difference, wherein said predicting said third logarithmic gain comprises adding said selected second value and said logarithm of said second gain value to obtain a second sum, subtracting said constant offset from said second sum to obtain a second difference, and predicting said third logarithmic gain based on said second difference.

6. In a code excited linear prediction decoder, a method of processing low bit rate speech signals to synthesize output speech, receiving a low bit rate first speech signal, selecting a first codevector from a codebook of vectors based on said received low bit rate first speech signal, scaling said selected first codevector by a first gain value, selecting a first value, corresponding to said selected first codevector, from a table comprising the logarithms of the root-mean-squared values of a plurality of codevectors from said codebook, predicting a second logarithmic gain value based on said selected first value and the logarithm of said first gain value, obtaining the inverse logarithm of said predicted second logarithmic gain value to determine a second gain value, synthesizing a first segment of said output speech based on said first gain scaled first codevector, receiving a low bit rate second speech signal, selecting a second codevector from said codebook based on said received low bit rate second speech signal, scaling said selected second codevector by said second gain value, selecting a second value, corresponding to said selected second codevector, from said table comprising said logarithms of said root-mean-squared values of said plurality of codevectors from said codebook, predicting a third logarithmic gain value based on said selected second value and the logarithm of said second gain value, obtaining the inverse logarithm of said predicted third logarithmic gain value to determine a third gain value for use in processing a low bit rate third speech signal, and synthesizing a second segment of said output speech based on said second gain scaled second codevector.

7. A method in accordance with claim 6 wherein the arithmetic operations of said method in said decoder are performed using fixed-point arithmetic, and wherein said receiving comprises receiving said low bit rate first speech signal from an encoder having a table identical to said table comprising the logarithms of the root-mean-squared values of a plurality of codevectors from said codebook, and wherein arithmetic operations are performed in said encoder using floating-point arithmetic.

8. A method in accordance with claim 6 wherein the arithmetic operations of said method in said decoder are performed using floating-point arithmetic, and wherein said receiving comprises receiving said low bit rate first speech signal from an encoder having a table identical to said table comprising the logarithms of the root-mean-squared values of a plurality of codevectors from said codebook, and wherein arithmetic operations are performed in said encoder using fixed-point arithmetic.

9. A method in accordance with claim 6 wherein said decoder is a low-delay code excited linear prediction decoder.

10. In a code excited linear prediction encoder comprising a codebook of vectors, a gain scaling unit for scaling vectors from said codebook, and means for processing input speech and scaled vectors from said gain scaling unit to generate low bit rate speech signals representing said input speech, a method of adjusting the gain value of said gain scaling unit from a first gain value, corresponding to a first segment of said input speech, to a second gain value, corresponding to a second segment of said input speech, said method comprising selecting, based on said first segment of said input speech, a vector from said codebook, selecting a value, corresponding to said selected vector, from a table comprising the logarithms of the root-mean-squared values of said vectors of said codebook, predicting a logarithmic gain value corresponding to said second segment of said input speech based on said value selected from said table and the logarithm of said first gain value, obtaining the inverse logarithm of said predicted logarithmic gain value to determine said second gain value, and adjusting the gain value of said gain scaling unit from said first gain value to said second gain value.

11. In a code excited linear prediction decoder for synthesizing speech based on low bit rate speech signals, said decoder comprising a codebook of vectors, a gain scaling unit for scaling vectors from said codebook, and means for synthesizing speech based on said scaled vectors, a method of adjusting the gain value of said gain scaling unit from a first gain value, corresponding to a low bit rate first speech signal, to a second gain value, corresponding to a low bit rate second speech signal, said method comprising selecting, based on said low bit rate first speech signal, a vector from said codebook, selecting a value, corresponding to said selected vector, from a table comprising the logarithms of the root-mean-squared values of said vectors of said codebook, predicting a logarithmic gain value corresponding to said low bit rate second speech signal based on said value selected from said table and the logarithm of said first gain value, obtaining the inverse logarithm of said predicted logarithmic gain value to determine said second gain value, and adjusting the gain value of said gain scaling unit from said first gain value to said second gain value.

* * * * *